US006790083B1

(12) United States Patent
Chen

(10) Patent No.: US 6,790,083 B1
(45) Date of Patent: Sep. 14, 2004

(54) SIGNAL LINE CONNECTOR

(76) Inventor: Chiung-Ling Chen, 6F, No. 55, Chang-Hsin Street, Wen-Shan District, Taipei City (TW)

( * ) Notice: Subject to any disclaimer, the term of this patent is extended or adjusted under 35 U.S.C. 154(b) by 0 days.

(21) Appl. No.: 10/615,779

(22) Filed: Jul. 10, 2003

(51) Int. Cl.[7] ..... H01R 9/05
(52) U.S. Cl. ..... 439/583; 439/578; 439/584
(58) Field of Search ..... 439/578, 583, 439/584

(56) References Cited

U.S. PATENT DOCUMENTS 4,923,412 A * 5/1990 Morris ..... 439/578
5,167,532 A * 12/1992 Bruno et al. ..... 439/578
5,607,325 A * 3/1997 Toma ..... 439/578
6,089,912 A * 7/2000 Tallis et al. ..... 439/584

* cited by examiner

*Primary Examiner*—P. Austin Bradley
*Assistant Examiner*—Briggitte R. Hammond
(74) *Attorney, Agent, or Firm*—Rabin & Berdo, P.C.

(57) ABSTRACT

A signal line connector includes a locknut, a hollow cylindrical casing, the casing having a coupling neck mounted with a gasket ring and fitted into the locknut, a locating barrel fitted into the other end of the casing, the locating barrel having an inside annular flange, and a center holding down tube mounted in the casing and secured to the locknut by the casing, the center holding down tube having a barbed portion facing the inside annular flange of the center holding down tube and adapted to hold down the tubular outer conductor and outer insulative layer of a signal line against the inside wall of the locating barrel, keeping the center conductor of the signal line axially suspended in the locknut.

3 Claims, 7 Drawing Sheets

SIGNAL LINE CONNECTOR

BACKGROUND OF THE INVENTION

1. Field of the Invention

The present invention relates to connectors and, more specifically, to a signal line connector, which comprises a hollow cylindrical casing fastened to a locknut to hold a center holding down tube on the inside, a gasket ring mounted in between the hollow cylindrical casing and the locknut to seal the gap, and a locating barrel fitted into the hollow cylindrical casing and adapted to hold down the tubular outer conductor and outer insulative layer of a signal line outside the center holding down tube, for enabling the center conductor to be axially suspended in the locknut.

2. Description of the Related Art

A conventional signal line connector is known comprising a connector body affixed to a thin tube for accommodating a signal line. After insertion of a signal line into the connector body and the thin tube a crimping device is used to crimp and distort the thin tube, causing the thin tube to be fixedly secured to the signal line. When crimping the thin tube, the thin tube may break along its seam line. Therefore, a contact error may occur, or the signal line may be separated from the signal line connector when the signal line stretched. There is also known a coaxial cable connector in which a socket is rotatably coupled to a hollow cylindrical casing and defines with the casing an annular space, and a locating member having an axially extended tapered hole is sleeved onto the rear extension of the barrel for squeezing the socket to hold down a coaxial cable. The installation procedure of this design is complicated. If the coaxial cable is curved or stretched during installation, the locating member tends to be vibrated and loosened, resulting in a contact error or disconnection of the coaxial cable.

Therefore, it is desirable to provide a signal line connector that eliminates the aforesaid drawbacks.

SUMMARY OF THE INVENTION

The present invention has been accomplished under the circumstances in view. It is the main object of the present invention to provide a signal line connector, which holds down the signal line tightly when installed. It is another object of the present invention to provide a signal line connector, which effectively protects permeation of moisture. It is still another object of the present invention to provide a signal line connector, which is easy to install.

According to one aspect of the present invention, the signal line connector comprises a locknut, a hollow cylindrical casing, the hollow cylindrical casing having a coupling neck and fitted into the locknut, a locating barrel fitted into the other end of the hollow cylindrical casing, the locating barrel having an inside annular flange, and a center holding down tube mounted in the hollow cylindrical casing and secured to the locknut by the hollow cylindrical casing, the center holding down tube having a barbed portion facing the inside annular flange of the locating barrel and adapted to hold down the tubular outer conductor and outer insulative layer of a signal line against the inside wall of the locating barrel, keeping the center conductor of the signal line axially suspended in the locknut. According to another aspect of the present invention, a gasket ring is mounted in an outside annular groove around the periphery of the coupling neck of the hollow cylindrical casing and stopped against the inside wall of the locknut to seal the gap.

According to still another aspect of the present invention, the hollow cylindrical casing has an inside annular groove in one end for the positioning of the locating barrel. According to still another aspect of the present invention, the locating barrel has outside annular flanges selectively engaged into the inside annular groove of the hollow cylindrical casing subject to the presence of the signal line, keeping the locating barrel secured to the hollow cylindrical casing.

DETAILED DESCRIPTION OF THE PREFERRED EMBODIMENT

Figure 1:
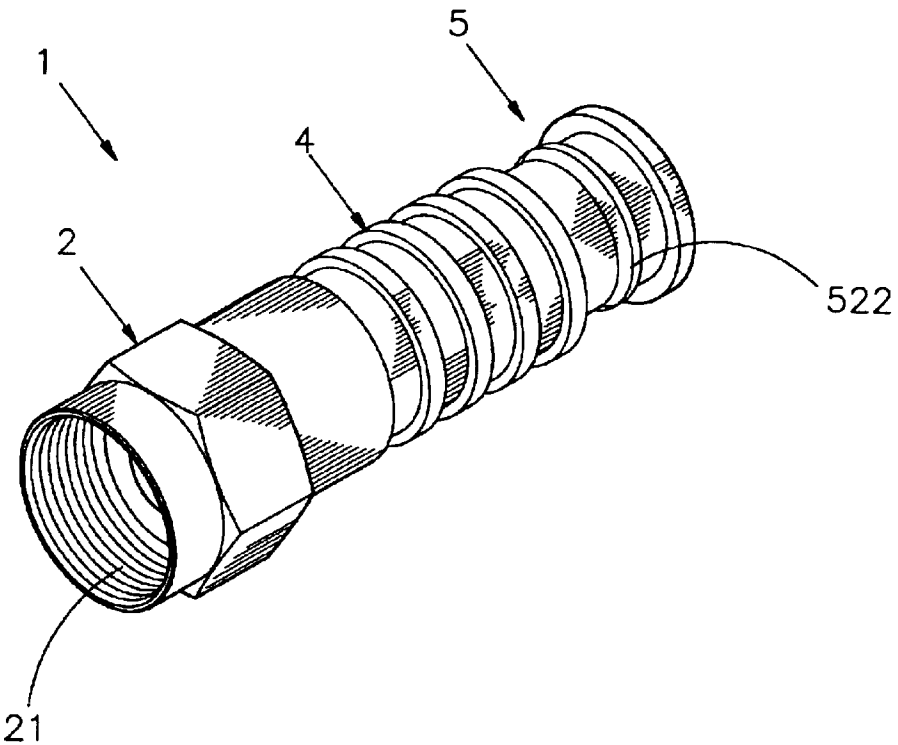
FIG. 1 is an elevational view of a signal line connector according to the present invention.
Figure 2:
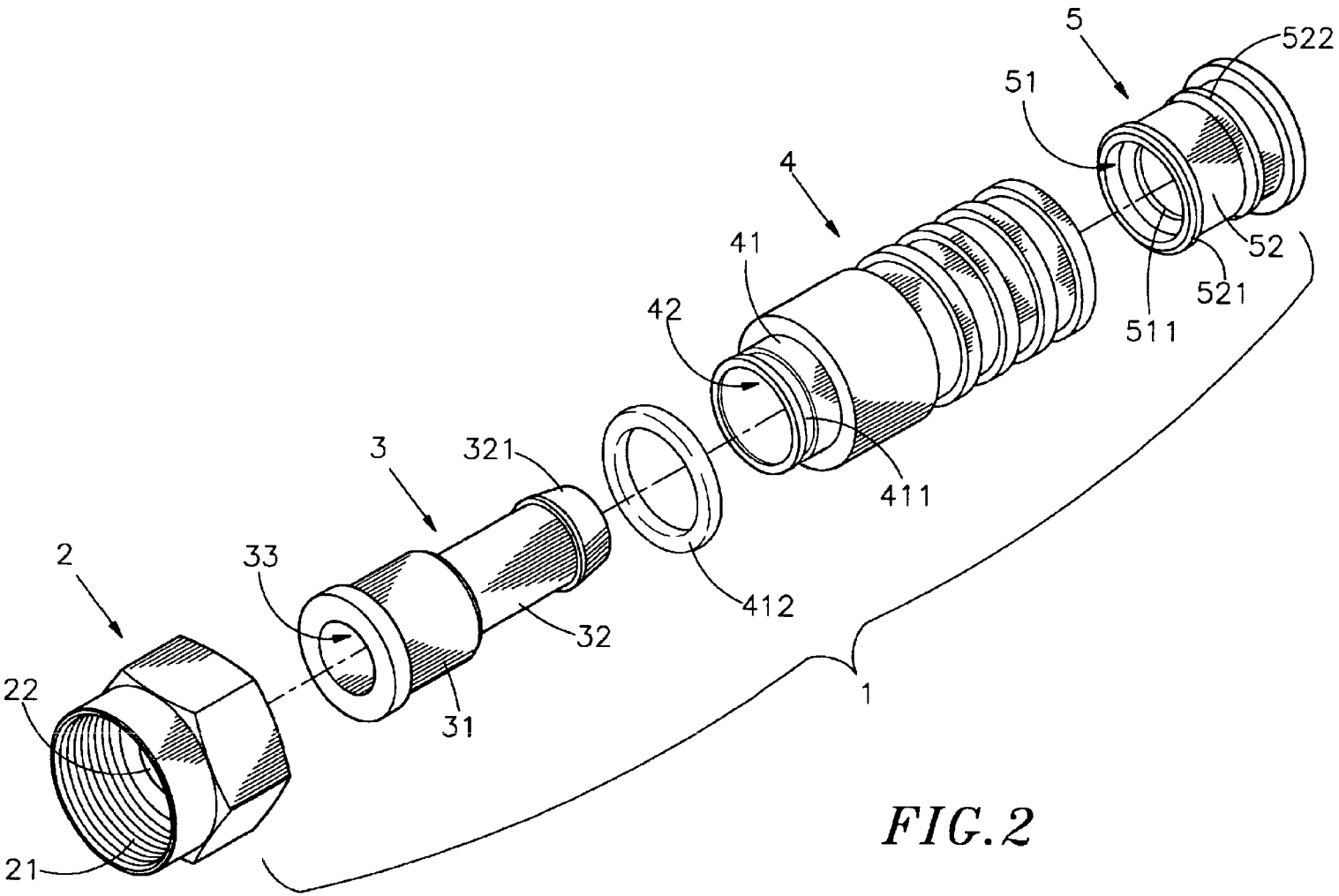
FIG. 2 is an exploded view of the signal line connector according to the present invention.
Figure 3:
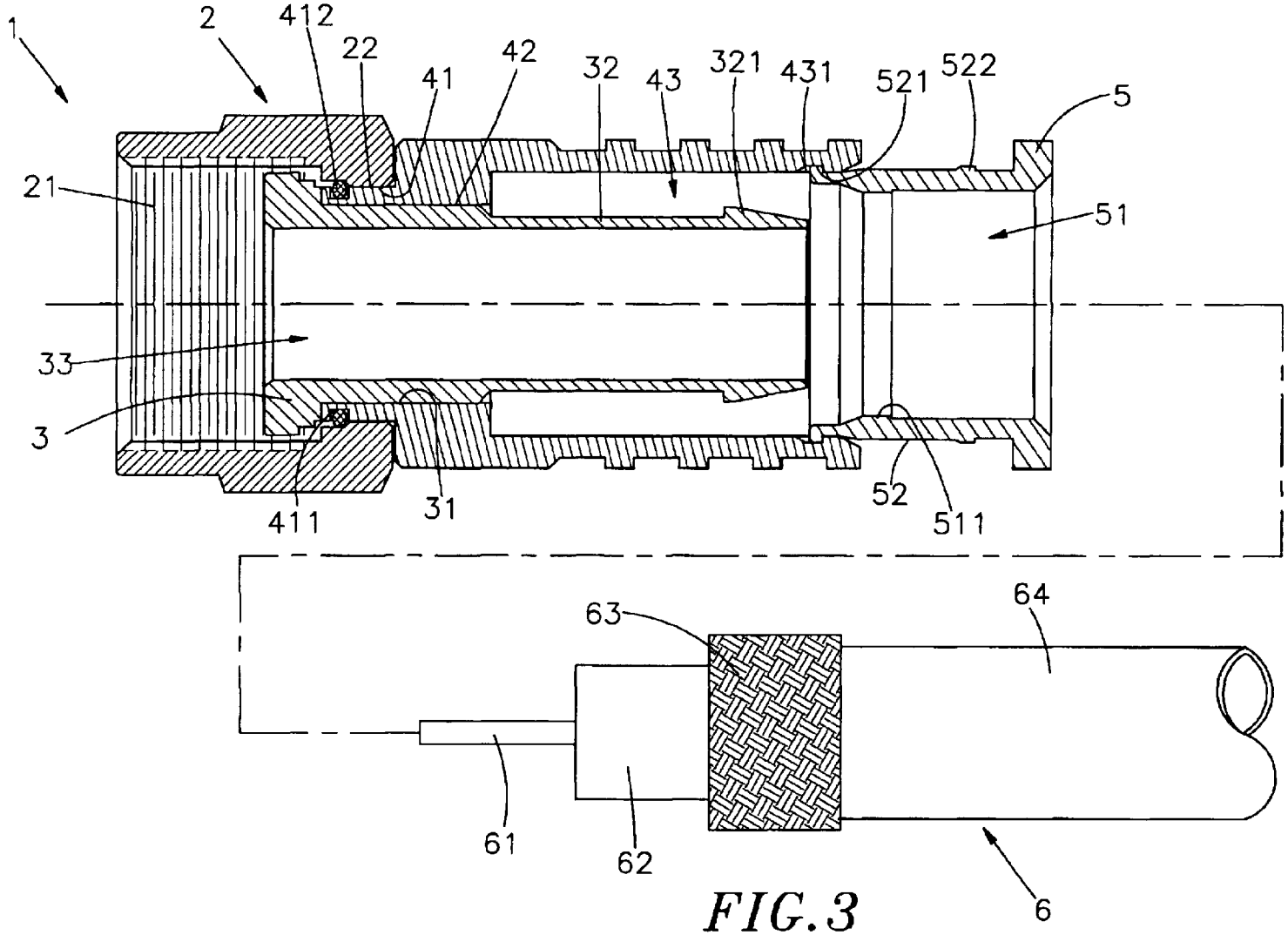
FIG. 3 is a sectional exploded view showing the relationship between the signal line connector and the signal line according to the present invention.

Referring to FIGS. 1~3, a signal line connector 1 in accordance with the present invention is shown comprised of a locknut 2, a center holding down tube 3, a hollow cylindrical casing 4, and a locating barrel 5.

The locknut 2 has an inner thread 21 in one end, namely, the rear end, and a coupling portion 22 in the other end, namely, the front end.

The center holding down tube 3 is coupled to the coupling portion 22 of the locknut 2, having a tube body 32, a barbed portion 321 at the front end of the tube body 32, a coupling portion 31 at the rear end of the tube body 32, and a passage hole 33 axially extended through the coupling portion 31, the tube body 32 and the barbed portion 321.

The hollow cylindrical casing 4 is mounted on the center holding down tube 3, having a coupling neck 41 axially extended from the rear end, an outside annular groove 411 around the periphery of the coupling neck 41, a rear coupling hole 42 and a front coupling hole 43 axially aligned in a line and respectively extended through the rear and front ends, and an inside annular groove 431 extended around the inside wall in the front coupling hole 43.

The locating barrel 5 is plugged into the front coupling hole 43 of the hollow cylindrical casing 4, having a receiving hole 51 axially extended through the front and rear ends, an inside annular flange 511 extended around the inside wall in the receiving hole 51, a first outside annular flange 521 around the rear end of the periphery 52, and a second outside annular flange 522 around a middle part of the periphery 52.

During the assembly process, a gasket ring 412 is mounted in the outside annular groove 411 of the hollow cylindrical casing 4, and then the center holding down tube 3 is plugged into the rear end of the hollow cylindrical casing 4 to engage the coupling portion 31 in the rear coupling hole 42 of the coupling neck 41, and then the center holding down tube 3 is fastened with the coupling neck 41 of the hollow cylindrical casing 4 to the coupling portion 22 of the locknut 2, and then the locating barrel 5 is plugged into the front coupling hole 43 of the hollow cylindrical casing 4 to engage the first outside annular flange 521 of the locating barrel 5 into the inside annular groove 431 of the hollow cylindrical casing 4.

Figure 4:
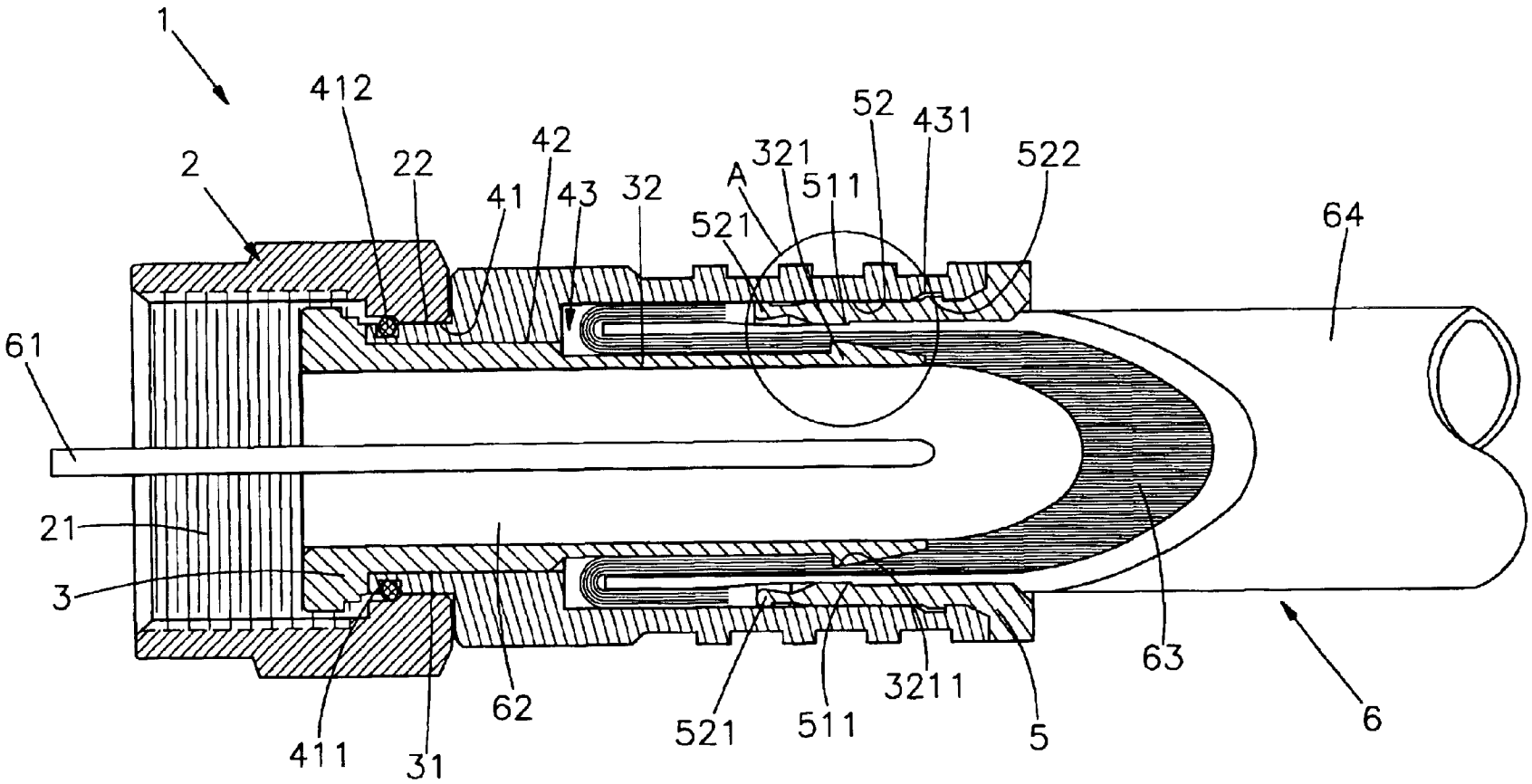
FIG. 4 is a sectional assembly view showing the signal line fastened to the signal line connector according to the present invention.

Referring to FIG. 4 and FIG. 3 again, when connecting the signal line connector 1 to a signal line 6, the signal line 6 is inserted through the receiving hole 51 of the locating barrel 5 to force the inner insulative layer 62 and the center conductor 61 into the passage hole 33 of the center holding down tube 3, causing the tubular outer conductor 63 and outer insulative layer 64 of the signal line 6 to be jammed in between the barbed portion 321 of the center holding down tube 3 and the inside wall of the hollow cylindrical casing 4, and then the locating barrel 5 is pushed inwards toward the inside of the inner end of the front coupling hole 43 to disengage the first outside annular flange 521 of the locating barrel 5 from the inside annular groove 431 of the hollow cylindrical casing 4 and to engage the second outside annular flange 522 of the locating barrel 5 into the inside annular groove 431 of the casing 4. When installed, the periphery 52 of the locating barrel 5 is radially inwardly forced by the periphery of the front coupling hole 43 of the hollow cylindrical casing 4 against the signal line 6 and the center holding down tube 3, thereby causing the barbed portion 321 of the center holding down tube 3 and the inside annular flange 511 of the locating barrel 5 to hold down the tubular outer conductor 63 and outer insulative layer 64 of the signal line 6 positively, and therefore the signal line 6 will not easily be pulled away from the signal line connector 1.

Figure 4A:
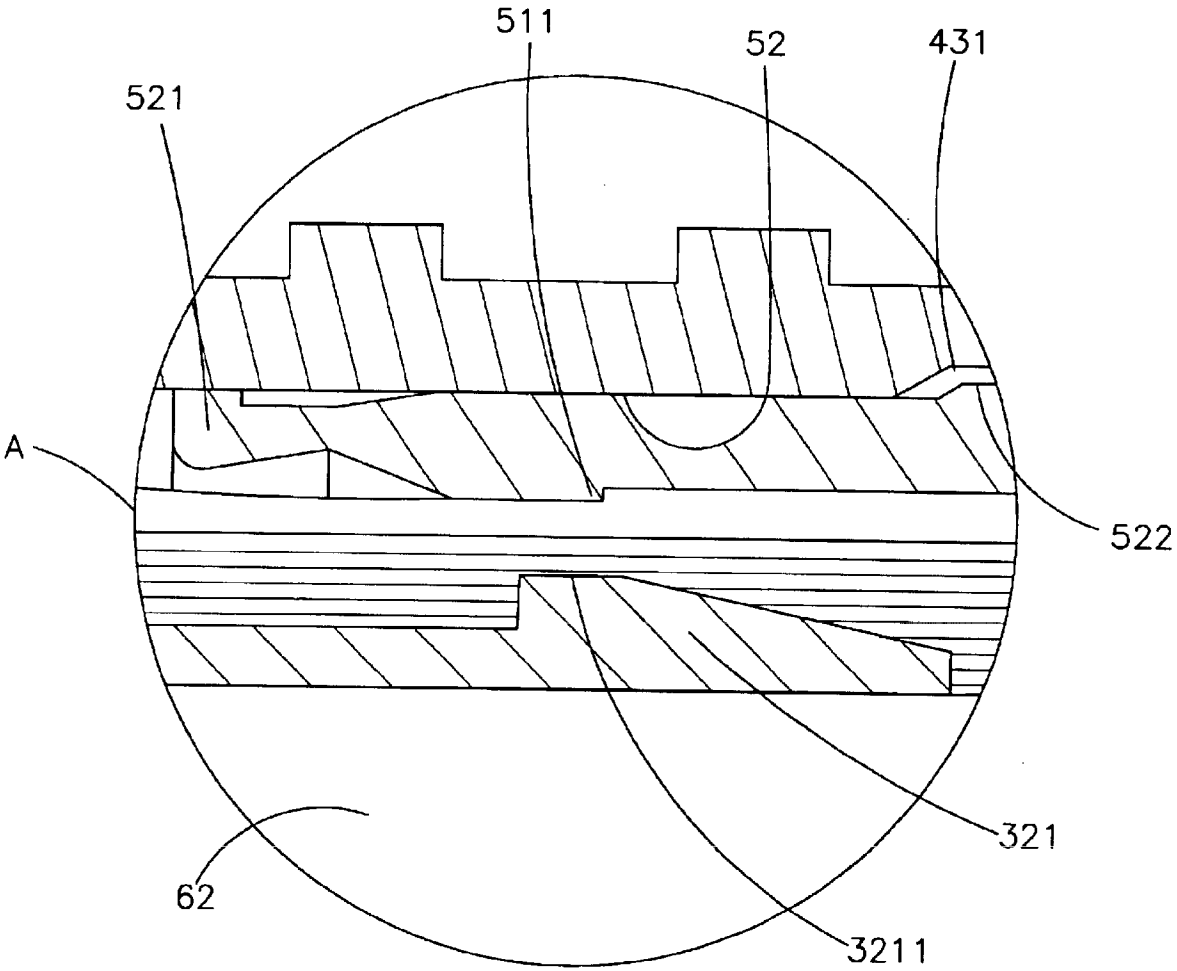
FIG. 4A is an enlarged view of a part of FIG. 4.

Referring to FIG. 4 and FIG. 4A again, when inserting the locating barrel 5 into the inside of the hollow cylindrical casing 4, the periphery 52 of the locating barrel 5 is squeezed to deform by the periphery of the front coupling hole 43 of the casing 4, and the inside annular flange 511 of the locating barrel 5 is aimed at a flat face 3211 of the barbed portion 321 of the center holding down tube 3, thereby causing the inside annular flange 511 of the locating barrel 5, the barbed portion 321 and the flat face 3211 of the center holding down tube 3 to hold down the signal line 6. Therefore, when stretching the signal line 6, the locating barrel 5 will not be pulled away from the hollow cylindrical casing 4, and the signal line 6 will be maintained connected to the signal line connector 1.

Figure 5:
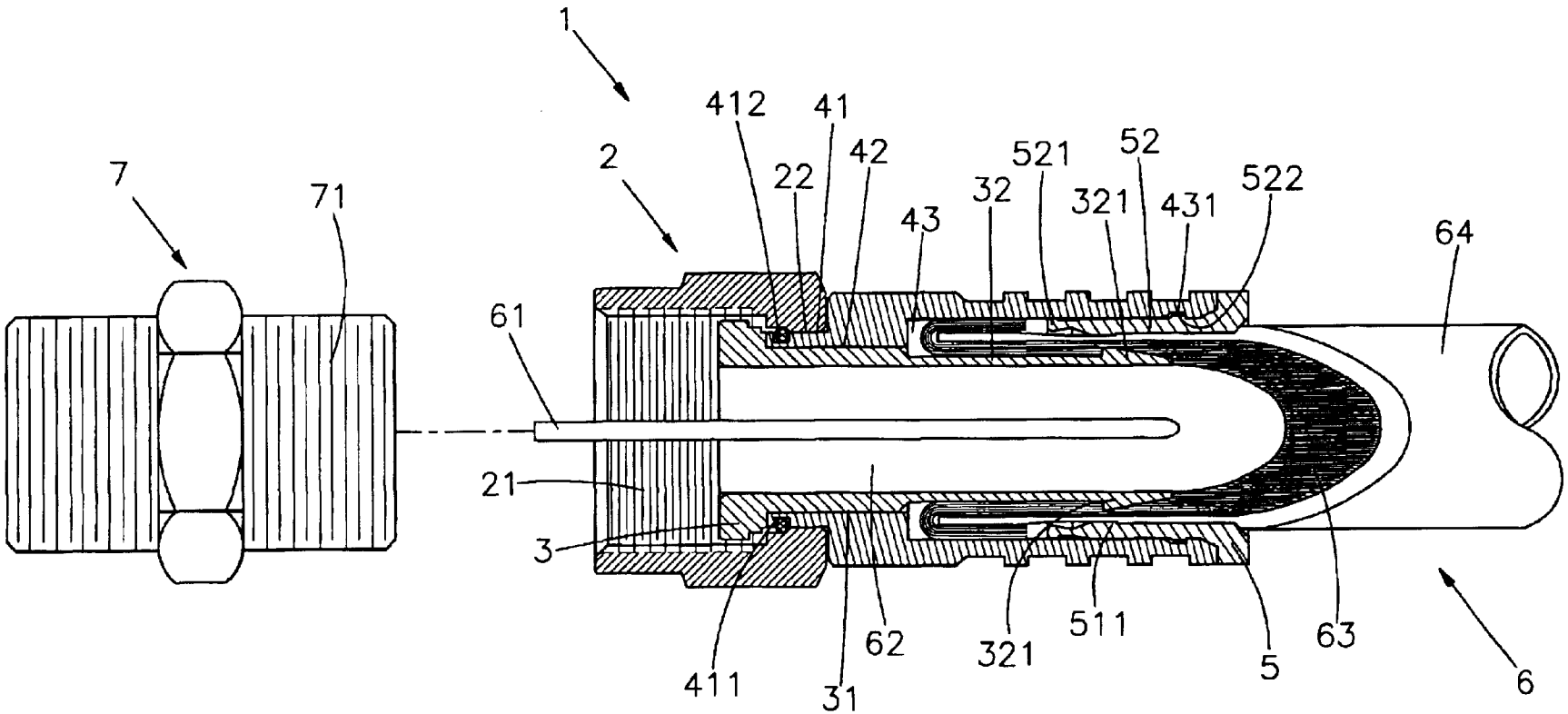
FIG. 5 is a sectional exploded view showing the relationship between the signal line connector and the adapter before installation of the signal line in the signal line connector according to the present invention.
Figure 6:
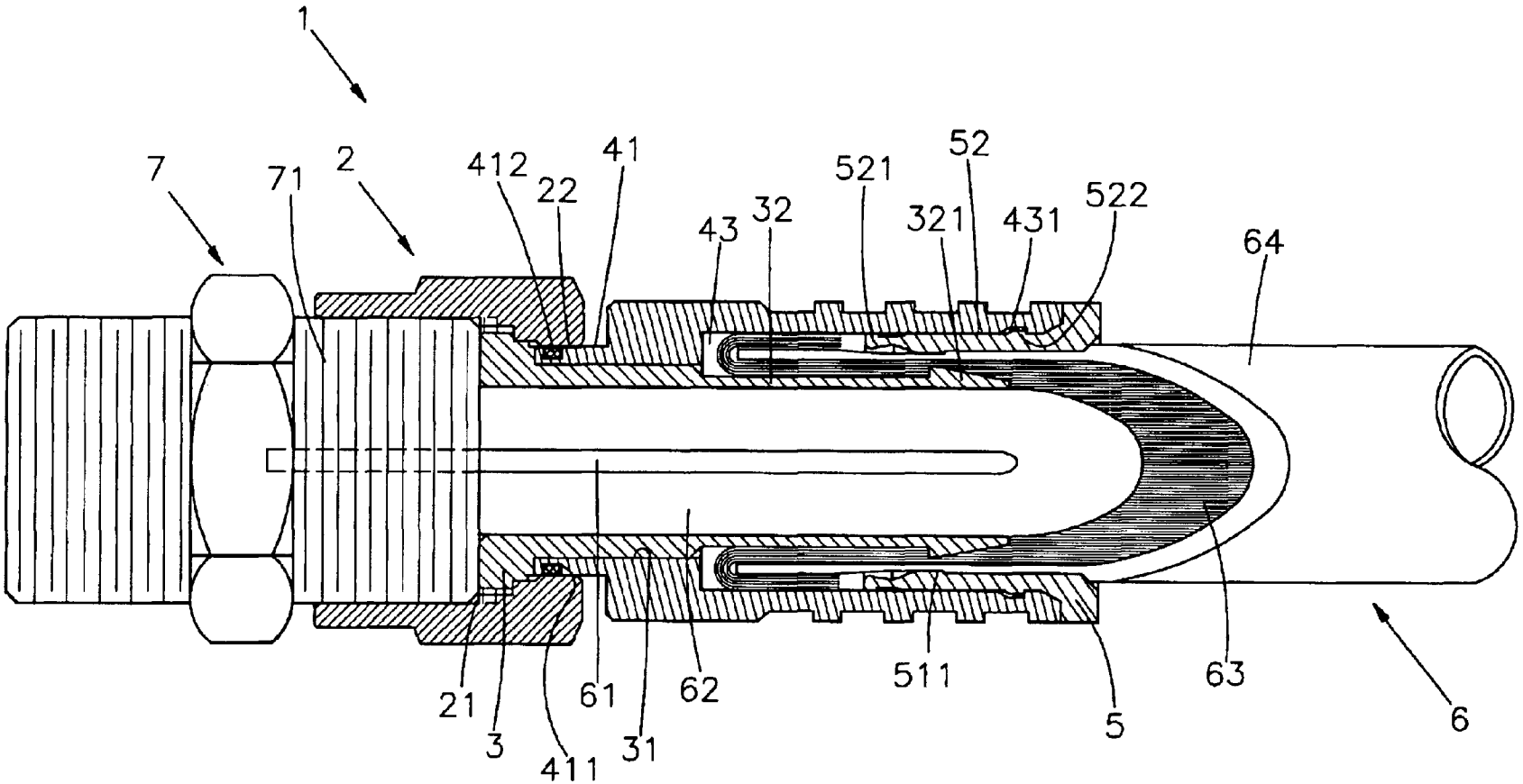
FIG. 6 is a sectional exploded view showing the relationship between the signal line connector and the adapter after installation of the signal line in the signal line connector according to the present invention.

Referring to FIGS. 5 and 6, after the connection of the signal line connector 1 and the signal line 6, the signal line connector 1 can then be connected to a adapter 7. When connecting the signal line connector 1 to the adapter 7, thread the inner thread 21 of the locknut 2 onto the outer thread 71 of the adapter 7, keeping the center conductor 61 of the signal line 6 axially suspended in the adapter 7 for signal transmission.

As indicated above, the present invention provides a signal line connector, in which the hollow cylindrical casing has one end mounted with a center holding down tube and then coupled to a locknut, and the other end mounted with a locating barrel. The center holding down tube and the locating barrel secure the signal line to the hollow cylindrical casing positively. Further, when the hollow cylindrical casing and the locknut fastened up, the gasket ring seats the gap between the hollow cylindrical casing and the locknut against moisture.

A prototype of signal line connector has been constructed with the features of FIGS. 1~6. The signal line connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A signal line connector comprising:

a locknut, said locknut having an inner thread in a first end thereof for threading onto an outer thread at a adapter, and a coupling portion in a second end thereof;

a center holding down tube coupled to the coupling portion of said locknut, said center holding down tube comprising a tube body, a barbed portion at one end of said tube body, a coupling portion at an opposite end of said tube body, and a passage hole axially extended through the coupling portion, tube body and barbed portion of said center holding down tube;

a hollow cylindrical casing mounted to said center holding down tube, said hollow cylindrical casing comprising a coupling neck axially extended from a rear end thereof and press-fitted into the coupling portion of said locknut to hold down said center holding down tube, a rear coupling hole, which accommodates the coupling portion of said center holding down tube, a front coupling hole, and an inside annular groove in said front coupling hole;

a gasket ring mounted around the coupling neck of said hollow cylindrical casing and peripherally stopped against the coupling portion of said locknut; and a locating barrel plugged into the front coupling hole of said hollow cylindrical casing, said locating barrel comprising a receiving hole axially extended through two distal ends thereof and adapted to accommodate a signal line, an inside annular flange extended around an inside wall thereof in said receiving hole and adapted to hold down a signal line in said receiving hole, a first outside annular flange and a second outside annular flange respectively extended around the periphery thereof for selectively engaging the inside annular groove of said hollow cylindrical casing.

2. The signal line connector as claimed in claim 1, wherein said coupling neck of said hollow cylindrical casing has an outside annular groove extended around the periphery thereof; said gasket ring is mounted in the outside annular groove around the periphery of said coupling neck of said hollow cylindrical casing.

3. The signal line connector as claimed in claim 1, wherein said barbed portion of said center holding down tube has a flat face facing the inside annular flange of said locating barrel.

* * * * *